US005788481A

United States Patent [19]

Von Beckmann

[11] Patent Number: 5,788,481

[45] Date of Patent: Aug. 4, 1998

[54] CARBON REACTIVATION APPARATUS

[75] Inventor: Joerg Von Beckmann, Vancouver, Canada

[73] Assignee: Lockhead Haggerty Engineering & Manufacturing Co. Ltd., British Columbia, Canada

[21] Appl. No.: 558,814

[22] Filed: Nov. 15, 1995

[51] Int. Cl.[6] ..... F27B 7/00

[52] U.S. Cl. ..... 432/103; 432/107; 432/112; 432/113; 432/114; 110/246

[58] Field of Search ..... 432/103, 107, 432/112, 113, 114; 110/246

[56] References Cited

U.S. PATENT DOCUMENTS

| | | | |
|---|---|---|---|
| 39,637 | 8/1863 | Finken . | |
| 1,440,194 | 12/1922 | Winjberg . | |
| 1,599,072 | 9/1926 | Allien . | |
| 1,939,678 | 12/1933 | Evans et al. . | |
| 4,030,876 | 6/1977 | Akae et al. . | |
| 4,200,262 | 4/1980 | Evans et al. | 432/107 |
| 4,376,343 | 3/1983 | White et al. | 432/112 |
| 4,431,405 | 2/1984 | Eatherton | 432/103 |
| 4,451,231 | 5/1984 | Murray et al. | 432/112 |
| 4,541,346 | 9/1985 | Culliford | 432/113 |
| 4,941,822 | 7/1990 | Evans et al. | 432/112 |
| 5,096,415 | 3/1992 | Coucher | 432/112 |
| 5,162,275 | 11/1992 | Wilson et al. . | |
| 5,482,458 | 1/1996 | Kyffin | 432/103 |

FOREIGN PATENT DOCUMENTS

| | | |
|---|---|---|
| 51-38275 | 3/1976 | Japan . |
| 104456 | 7/1916 | United Kingdom . |
| WO/90/07979 | 7/1990 | WIPO . |

*Primary Examiner*—Henry A. Bennett
*Assistant Examiner*—Jiping Lu
*Attorney, Agent, or Firm*—Cooley Godward LLP

[57] ABSTRACT

A carbon reactivation apparatus has a fossil fuel kiln adjacent to a rotary dryer and flue gas from the kiln flows through the dryer co-currently with carbon particles to provide a more efficient process than previously known. The apparatus has a rotary kiln with a drum therein sloped downwards from a feed end to a discharge end, a furnace shell surrounding at least a portion of the drum with a fossil fuel heater and hot gases from within the shell heat the rotary kiln. A rotary dryer slopes downwards from an inlet end to an outlet end and carbon particles to be reactivated are fed into the inlet end. Ducting from the shell surrounding the drum of the rotary kiln extends to the inlet end of the rotary dryer for hot gases to flow along the dryer to the outlet end in the same direction as the carbon particles. Carbon particles are discharged from the outlet end of the rotary dryer into the feed end of the rotary kiln, the carbon particles being separated from the hot gases in the rotary dryer, and there is an exhaust system to exhaust the hot gases from the outlet end of the dryer.

15 Claims, 3 Drawing Sheets

CARBON REACTIVATION APPARATUS

TECHNICAL FIELD

The present invention relates to reactivating carbon and more specifically to volatilizing the fouling agents absorbed by carbon particles so that the carbon can be reactivated and reused.

BACKGROUND ART

Activated carbon because of its adsorptive qualities is used in many industries. One example is water treatment where water is filtered through activated carbon. It is also used for extraction of gold and other precious metals from solutions. Because of the high cost of activated carbon, it is reused if and when possible by being reactivated. This is especially true in the precious metals industry because of the large quantities of activated carbon used and the rapid fouling of the carbon particles that occurs. In order to reactivate carbon it must be heated up to a temperature between about 600° C. and 800° C. for a period of time sufficient to volatilize the fouling agents and open the pores and active sites on the carbon particles. The carbon particles are typically granular, either naturally occurring or extruded. Particle size is generally in the range of 6×24 mesh. The reactivation process is generally carried out in an indirectly heated kiln.

In existing reactivation processes, carbon particles are conveyed to the kiln by pumping or educting and dewatered through a dewatering screen. The carbon particles are generally conveyed at a higher rate than the kiln's production rate, thus the dewatered carbon particles are held in a surge bin. In most cases the dewatered carbon particles have a moisture content of between about 40% and 50% wet basis as metered to the kiln.

There are many different kiln designs available but the most successful and reliable kiln has been the horizontal indirectly heated kiln. The two most common versions of this kiln are fossil fuel (which includes but is not limited to No. 2 oil, propane gas or natural gas) fired kilns and electrically heated kilns.

The major differences between the fossil fuel and the electric kiln are the sources of energy and their energy efficiencies. For a given size of kiln, each produces the same quantity and quality of product.

The most energy efficient kiln is the electric kiln which transfers its heat to the process through radiation and free convection. There is no combustion taking place in the furnace and there are no exhaust stacks, although the volatile gases produced by heating must be vented. The only energy losses are those from the kiln shell surface, the furnace surface losses, and electrical conductor losses. All of these losses are small and the overall efficiency of the process can be in excess of 75%. The kiln shell surface losses are required for product cooling and these losses together with the electrical conductor losses may be controlled through good design.

The fossil fuel kiln has the same energy losses as the electric kiln except for the conductor losses. The fossil fuel kiln however has a significant energy loss due to combustion products which must be expelled from the furnace. As the operating temperature in the furnace increases, the efficiency of the furnace decreases. If the process temperature is 700° C., then the products of combustion must be at this temperature or higher. The high volume of high temperature gas reduces the efficiency of the fossil fuel kiln to between 30% and 40% in the reactivation temperature range depending on the air to fuel ratio.

In order to increase the energy efficiency of the fossil fuel kiln, the heat from the kiln furnace flue must be recovered. Recovery methods include preheating the combustion air by means of a heat exchanger to remove the heat from the flues. In practical and economic terms, the preheating of combustion air has a temperature limit. This may bring the overall efficiency to about 50%.

Other methods include directing the furnace flue gases through the kiln itself in a counterflow arrangement. The counterflow approach has both technical and process problems associated with it since the temperature of the fouling agents is continually dropping which can result in condensation of these agents back into the carbon.

DISCLOSURE OF INVENTION

We have now found that by utilizing a fossil fuel kiln with a rotary dryer positioned above the kiln and utilizing flue gas from the kiln to flow through the heater co-currently with the carbon particles, the overall efficiency of the process rises to approximately 75%.

The present invention provides a carbon reactivation apparatus comprising a rotary kiln with a drum therein sloped downwards from a feed end to a discharge end, means to rotate the drum, a furnace shell surrounding at least a portion of the drum in the rotary kiln with fossil fuel heating means and air circulating means to circulate hot gases within the shell and heat the rotary kiln, a rotary dryer mounted above the rotary kiln, the rotary dryer sloped downwards from an inlet end to an outlet end, the inlet end positioned over the discharge end of the rotary kiln, and the outlet end positioned over the feed end of the rotary kiln, means to rotate the rotary dryer, feed means to feed carbon particles to be reactivated into the inlet end of the rotary dryer, ducting from the shell surrounding the drum of the rotary kiln leading up to the inlet end of the rotary dryer for hot gases from the shell to flow along the dryer to the outlet end in the same direction as the carbon particles, gravity discharge line from the outlet end of the rotary dryer to discharge carbon particles the feed end of the rotary kiln, the gravity discharge line having separating means therein to separate the carbon particles from the hot gases in the rotary dryer, and exhaust means to exhaust the hot gases from the outlet end of the dryer.

In another embodiment there is provided a method of reactivating carbon comprising the steps of heating and circulating hot gases in a furnace shell surrounding at least a portion of a rotating drum within a rotary kiln, circulating the hot gases from the shell upward into an inlet end of a rotary dryer located above the rotary kiln, the inlet end of the rotary dryer positioned above a discharge end of the rotary kiln and an outlet end of the rotary dryer positioned above a feed end of the rotary kiln, feeding carbon particles to be reactivated into the inlet end of the rotary dryer, the rotary dryer sloping downwards from the inlet end to the outlet end, rotating the rotary dryer to assist moving the carbon particles toward the outlet end, and heating the carbon particles with the hot gases flowing through the rotary dryer in the same direction as the carbon particles, dropping the carbon particles from the outlet end of the rotary dryer to the feed end of the rotating drum within the rotary kiln, and separating the carbon particles from the hot gases in the rotary dryer, conveying the carbon particles through the rotating drum of the rotary kiln, the drum sloping downwards toward the discharge end, to heat the carbon particles as the drum is heated by the furnace shell, and depositing the carbon particles from the discharge end of the rotating drum into a quench tank.

BRIEF DESCRIPTION OF DRAWINGS

In drawings which illustrate embodiments of the present invention.

BEST MODE FOR CARRYING OUT THE INVENTION

Figure 1:
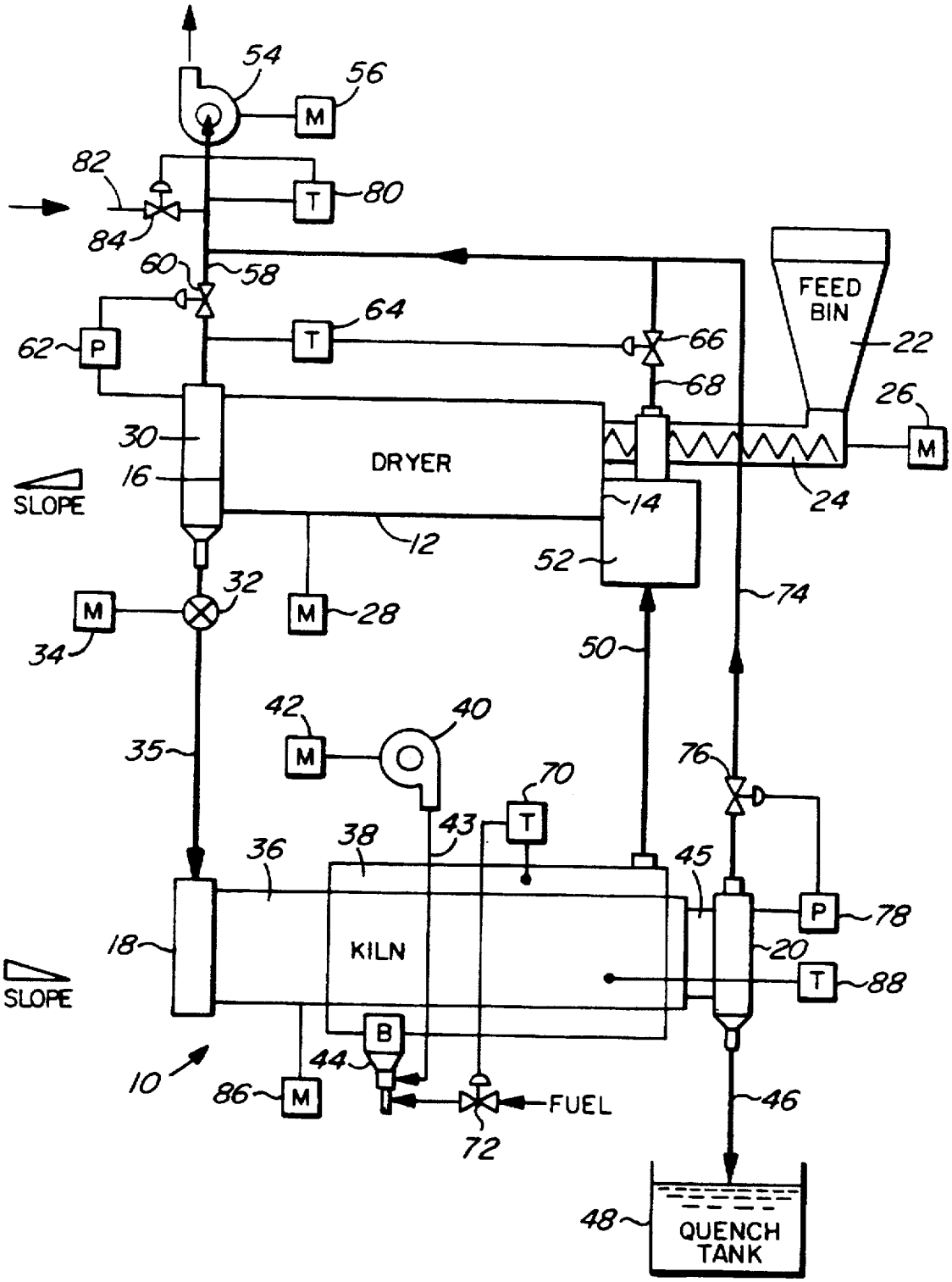
FIG. 1 is a schematic diagram showing one embodiment of the carbon reactivation apparatus according to the present invention.

As shown schematically in FIG. 1, a generally horizontal kiln 10 is positioned below a generally horizontal dryer 12. The dryer 12 is piggy-backed over the kiln 10 with the dryer 12 sloping from an inlet end 14 to an outlet end 16 and the kiln 10 sloping the other way from a feed end 18 positioned substantially below the outlet end 16 of the dryer 12 to a discharge end 20 positioned substantially below the inlet end 14 of the dryer 12.

Wet carbon particles to be reactivated are fed into a feed bin 22 and are conveyed to the inlet end 14 of the dryer 12 by means of a screw conveyor 24 driven by motor 26. While a screw conveyor 24 is shown, other known types of conveying devices may also be used to feed the carbon particles to the inlet end 14 of the dryer 12. The carbon particles move along the dryer 12 as it is rotated by motor 28. The dryer 12 has internal flights (not shown) which cause the wet particles to fall in showers or curtains as the dryer rotates and the slope in the dryer 12 causes movement of the particles towards the outlet end 16. The carbon particles are heated by hot gases flowing in the same direction as the carbon particles and passing through the carbon particle curtains. The hot gases are produced by the kiln 10 in a manner to be described.

At the outlet end 16 of the dryer 12 is a discharge hood 30 and the carbon particles are separated from the hot gases as they drop into a rotary gate valve 32 driven by motor 34, through a gravity discharge line 35, and into the feed end 18 of the kiln 10. The rotary gate valve 32 acts as a separating device to separate the carbon particles from the flue gases in the dryer 12. Thus, little or no gas from the dryer 12 passes into the kiln 10. While a rotary gate valve 32 is described and shown, other suitable separating devices may be used.

The carbon particles move in a rotary drum 36 forming part of the kiln 10 which is sloped downward from the feed end 18 to the exit end 20. The rotary drum 36 has flights (not shown) which turn over the carbon particles to increase the heat transfer area. The carbon particles move along the drum 36. The time the carbon particles remain in the drum 36 is sufficient for reactivation to occur. The temperature of the particles in the kiln drum is preferably in the order of 600° C. to 800° C. so that a combination of the temperature and time is sufficient to volatize the fouling agents and reactivate the carbon particles.

A furnace shell 38 surrounds the drum 36 of the kiln 10. The shell 38 provides an insulated shroud around the drum and a fan 40 powered by motor 42 provides air through an entry air duct 43 to a burner 44 or burners which utilizes a fuel such as propane, natural gas or oil, resulting in hot combusted gases being injected into the shell 38. The shell 38 is separate from the interior of the drum 36, therefore, the hot gases or flue gases do not enter the drum 36 and contact the carbon particles therein. The furnace shell 38 ends before the end of the drum 36, therefore there is a cooling stage 45 for the carbon particles as they are passing along the drum 36 before discharging from the discharge end 20 and dropping through a chute 46 into a quench tank 48. A seal is provided in the quench tank as the chute 46 extends below the level of the liquid in the quench tank 48 as may be seen in FIG. 1.

Flue gases from the furnace shell 38 pass upward in a duct 50 to an insulated breaching 52, and hence enter the inlet end 14 of the dryer 12. Thus, the flue gases which have heated the drum 36 of the kiln 10 now flow co-currently with the carbon particles in the dryer 12 to the outlet end 16. An exhaust fan 54 driven by motor 56 is connected to an exhaust duct 58 from the outlet end 16 of the dryer 12 and thus the hot flue gases that have passed down the dryer 12 are vented through the exhaust duct 58 by the exhaust fan 54.

The hot flue gases enter the dryer 12 at approximately 700° C. at the same position where the wet carbon particles enter the dryer. Thus, the coldest, wettest carbon particles come in contact with the hottest flue gases. The rotary dryer 12 is maintained at slightly negative pressure which is controlled by a damper valve 60 in the exhaust duct 58 and a pressure sensor 62 in the dryer 12 together with an automatic control loop. Thus the flue gases in the dryer 12 are drawn out by the exhaust fan 54.

A temperature sensor 64 is provided in the exhaust duct 58 where it joins the outlet end 16 of the dryer 12. The temperature of the flue gases leaving the dryer 12 affect the moisture content of the carbon particles leaving the dryer 12 and may be controlled by use of a damper valve 66 located in a flue gas bypass duct 68 from the flue gas duct 50 before entering the dryer 12. The flue gas bypass duct 68 allows a certain quantity of flue gases from the furnace shell 38 to bypass the dryer 12 and pass to the exhaust duct 58 and thus be vented through the exhaust fan 54. If the temperature in the dryer hood 30 at the outlet end 16 of the dryer 12 is too low, then the damper valve 66 closes forcing more flue gases to pass through the dryer 12.

The low temperature volatiles and water vapour are removed in the dryer 12 and join with flue gases exiting through the exhaust duct 58. Under normal operation there is no flue gas bypassing the dryer and in that configuration the process efficiency is at its maximum.

The moisture content of the carbon particles leaving the dryer 12 is typically 10% to 20%, although lower and higher moistures also are satisfactory. The actual moisture content of carbon particles at the dryer outlet 16 is not critical for the operation of the system but for any given moisture content of the carbon particles in the feed bin 22, there is a moisture content at dryer outlet 16 which maximizes the efficiency of the process. In normal operation the moisture content of the carbon particles is usually quite constant and correction for fluctuation is not necessary. The carbon particles are preheated to about 50° C. or higher by the rotary dryer 12.

The kiln furnace temperature, that is to say, the temperature in the furnace shell 38, is monitored by a temperature sensor 70 and a control loop provides a signal to a control valve 72 in the fuel line to the burner 44. By varying only the fuel flow or both the fuel and the air flow from the fan 40, the furnace temperature may be controlled to provide a constant temperature of the flue gases in the shell 38.

As the partially dried carbon particles pass along the kiln drum 36, the residual moisture is removed and the flow of steam produced flows co-currently with the product as it moves along the drum 36. The temperature of the carbon particles increases as they move along the drum 36 within the shell 38, as does the temperature of the steam and other volatiles that are released from the carbon particles. Thus, these higher temperature volatiles are less likely to condense on the carbon particles or on the equipment surrounding them. At the discharge end 20 of the kiln 10 the super heated steam and volatiles are removed by a kiln exhaust duct 74 which joins into the exhaust duct 58 from the dryer 12. The kiln exhaust duct 74 has a slightly negative pressure caused by the exhaust fan 54, which is controlled by a damper valve 76 in the kiln exhaust duct 74 activated by a pressure sensor 78 at the discharge end 20 of the kiln 10, and an appropriate control loop. The kiln exhaust gases passing through kiln exhaust duct 74 mix with the exhaust gases from the dryer 12 in the exhaust duct 58 and any dryer flue gases bypassing the dryer 12 from the bypass duct 68.

The exhaust fan 54 has a temperature sensor 80 to protect the fan 54 from overheating. An air inlet line 82 and a damper valve 84 with a control loop allow cooling air to enter the exhaust duct 58 just before the temperature sensor 80. This ensures that flue gases above a preset temperature do not enter the fan 54 as this might overheat the fan 54 and cause damage thereto.

The rotary drum 36 of the kiln 10 is rotated by a motor 86 generally at a preset speed. The temperature within the shell 38 is monitored by a temperature sensor 70. If the temperature rises above or below a preset point, then the fuel supply is controlled through valve 72. In another embodiment the air is controlled through a throttle valve (not shown) at the fan 40. The carbon particles pass through a short cooling section 45 at the end of the shell 38 before being deposited into the quench tank 48.

A temperature sensor 88 has a probe extending into the drum 36 at the end of the shell 38 to indicate the product temperature.

Figure 2:
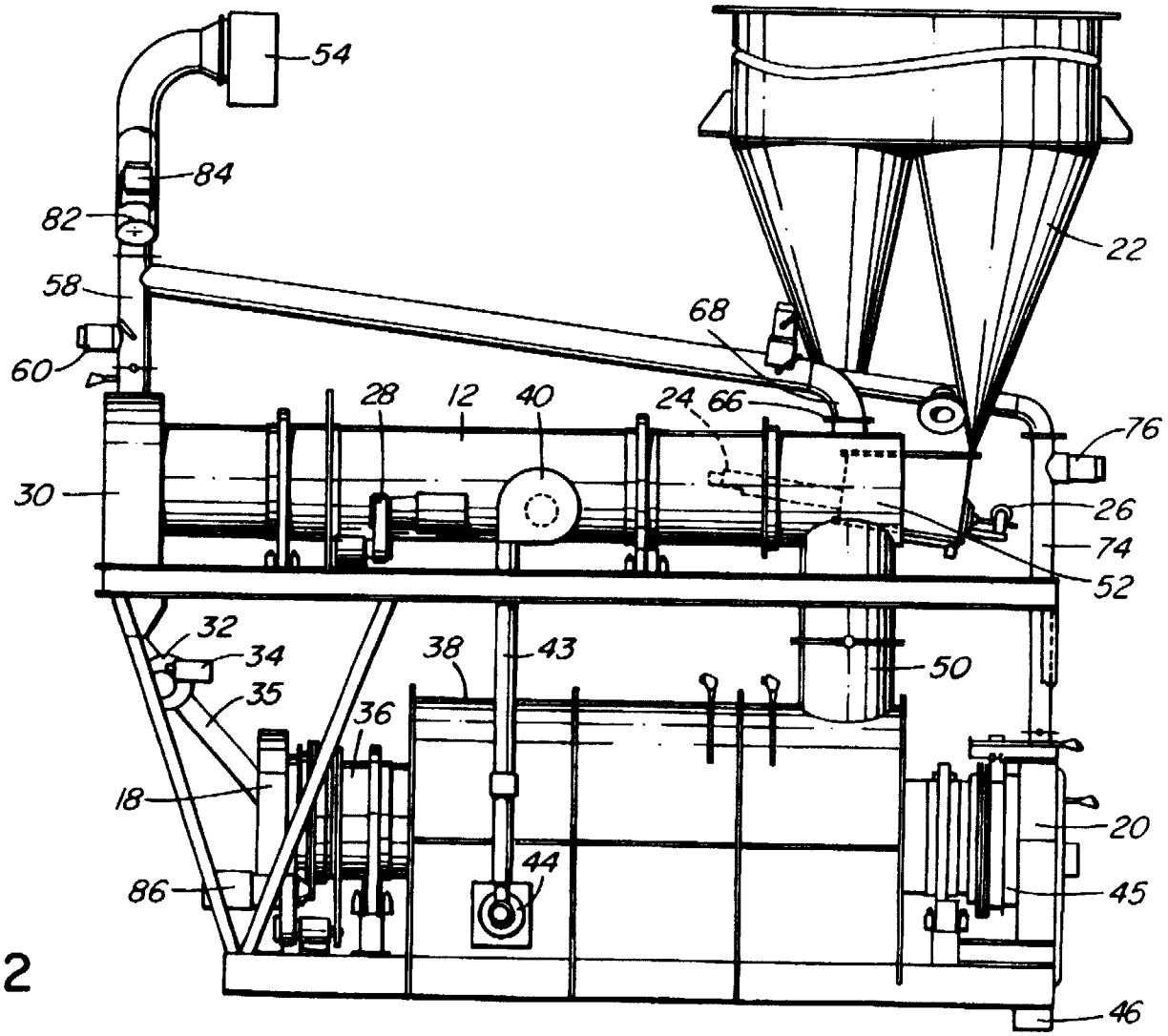
FIG. 2 is a side elevational view showing an arrangement of dryer and kiln according to one embodiment of the present invention.
Figure 3:
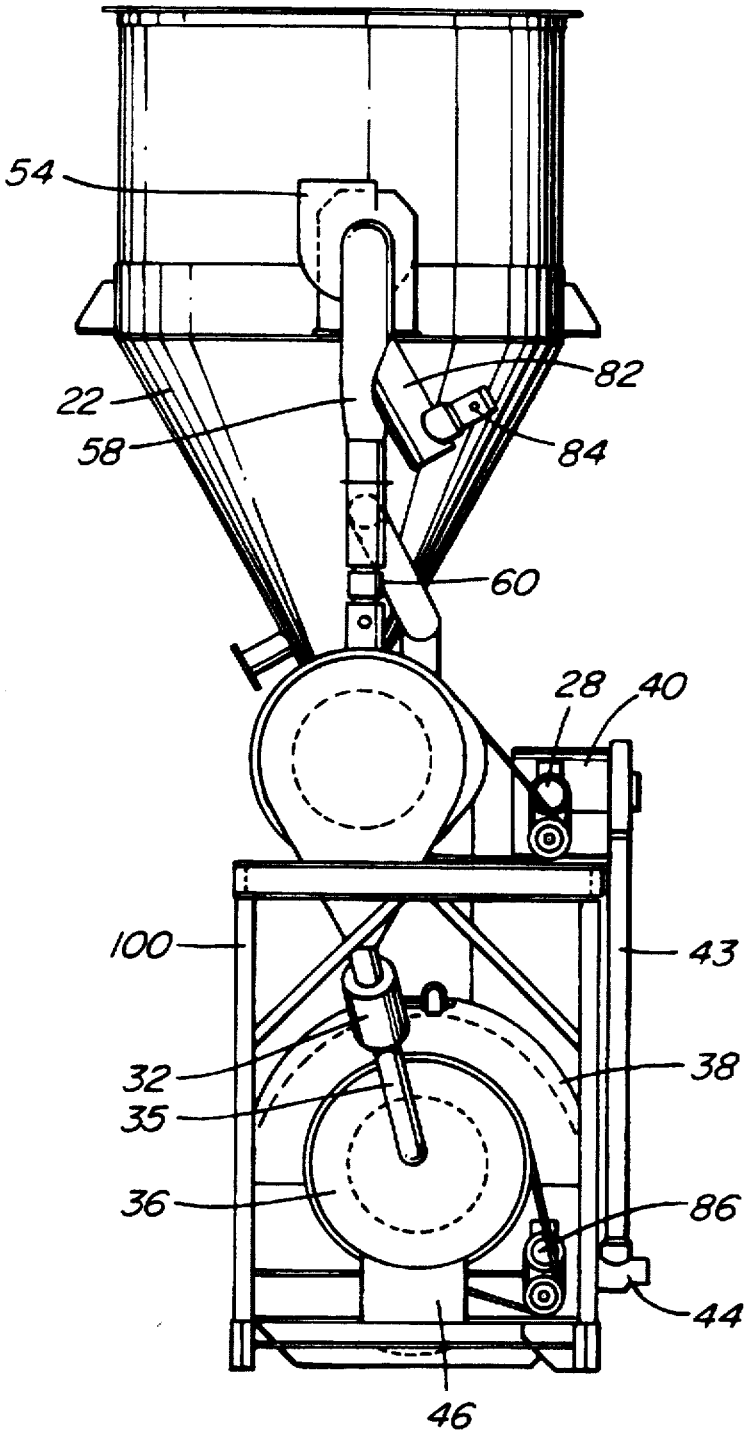
FIG. 3 is an end view showing the dryer and kiln arrangement of FIG. 2.

Referring now to FIGS. 2 and 3, details of the kiln 10 and dryer 12 arrangement may be seen mounted on a frame 100. The rotating mechanism for the dryer driven by motor 28 is illustrated in FIG. 3 and the rotating mechanism for the rotary drum 36 of the kiln is shown driven by motor 86. The various ducts are illustrated with the exhaust fan 54 exhausting flue gases through the exhaust duct 58, and the supply fan 40 providing air to the burner 44.

Although temperature and draft control strategies are used in various locations in the equipment, the process is inherently stable and self-regulating. If the product enters the dryer 12 at an abnormally high moisture content and the flue bypass damper 66 is already in the fully closed position, there is a decrease in temperature at the outlet end 16 of the dryer 12 because of the wetter product. Since the dryer control loop does not increase the heat input to the kiln, there is no way of maintaining the dryer discharge temperature of the carbon particles at the setpoint. This lower temperature results in the carbon moisture content leaving the dryer 12 being slightly higher than normal. When the wetter carbon particles reach the kiln 10, the kiln temperature drops and this is sensed and corrected by the temperature sensor 70 in the shell 30 through the kiln control loop and the heat input to the kiln 10 increases.

The increase in heat input makes more heat available at the kiln flue gas duct 50 and this provides the extra heat needed in the dryer 12. Similarly, if the carbon particles are too dry entering the kiln 10, the kiln furnace heat input is reduced which reduces the heat available to the dryer 12 and this in turn increase the moisture content of the carbon leaving the dryer 12.

Various changes may be made to the embodiments shown herein without departing from the scope of the present invention which is limited only to the following claims.

The embodiments of the present invention in which an exclusive property or privilege is claimed are defined as follows:

1. A carbon reactivation apparatus comprising:

a rotary kiln with a drum therein sloped downwards from a feed end to a discharge end;

means to rotate the drum;

a furnace shell surrounding at least a portion of the drum in the rotary kiln with fossil fuel heating means and air circulating means to circulate hot gases within the shell and heat the rotary kiln;

a rotary dryer sloped downwards from an inlet end to an outlet end;

means to rotate the rotary dryer;

feed means to feed carbon particles to be reactivated into the inlet end of the rotary dryer;

ducting from the shell surrounding the drum of the rotary kiln to the inlet end of the rotary dryer for hot gases from the shell to flow along the dryer to the outlet end in the same direction as the carbon particles;

discharge means from the outlet end of the rotary dryer to discharge carbon particles to the feed end of the rotary kiln, the discharge means having separating means therein to separate the carbon particles from the hot gases in the rotary dryer, and exhaust means to exhaust the hot gases from the outlet end of the dryer.

2. A carbon reactivation apparatus comprising:

a rotary kiln with a drum therein sloped downwards from a feed end to a discharge end;

means to rotate the drum;

a furnace shell surrounding at least a portion of the drum in the rotary kiln with fossil fuel heating means and air circulating means to circulate hot gases within the shell and heat the rotary kiln;

a rotary dryer mounted above the rotary kiln, the rotary dryer sloped downwards from an inlet end to an outlet end, the inlet end positioned over the discharge end of the rotary kiln, and the outlet end positioned over the feed end of the rotary kiln;

means to rotate the rotary dryer;

feed means to feed carbon particles to be reactivated into the inlet end of the rotary dryer;

ducting from the shell surrounding the drum of the rotary kiln leading up to the inlet end of the rotary dryer for hot gases from the shell to flow along the dryer to the outlet end in the same direction as the carbon particles;

gravity discharge line from the outlet end of the rotary dryer to discharge carbon particles to the feed end of the rotary kiln, the gravity discharge line having separating means therein to separate the carbon particles from the hot gases in the rotary dryer, and exhaust means to exhaust the hot gases from the outlet end of the dryer.

3. The carbon reactivation apparatus according to claim 2 including a feed bin to contain carbon particles to be reactivated, the feed bin positioned above the feed means.

4. The carbon reactivation apparatus according to claim 3 wherein the feed means is a screw conveyor.

5. The carbon reactivation apparatus according to claim 2 including a discharge chute from the discharge end of the rotary kiln leading to a quench tank, an exit end of the discharge chute positioned below liquid level in the quench tank.

6. The carbon reactivation apparatus according to claim 2 including a cooling section on the drum of the rotary kiln, the cooling section positioned between the furnace shell and the discharge end.

7. The carbon reactivation apparatus according to claim 1 wherein the separating means in the gravity discharge line to separate the carbon particles from the hot gases in the rotary dryer comprises a rotary gate valve, and means to rotate the valve.

8. The carbon reactivation apparatus according to claim 2 wherein the heating means and air circulating means to circulate hot gases within the furnace shell comprises a fossil fuel heater and an air blower to supply external air to the furnace shell.

9. The carbon reactivation apparatus according to claim 8 wherein the fossil fuel heater is selected from the group consisting of an oil burner, a propane gas burner, a natural gas burner and combinations thereof.

10. The carbon reactivation apparatus according to claim 2 wherein the exhaust means to exhaust the hot gases from the outlet end of the dryer includes an exhaust duct from the outlet end of the dryer leading to an exhaust fan and wherein a pressure sensor is provided on the exhaust duct with a damper means therein to maintain a negative pressure within the dryer.

11. The carbon reactivation apparatus according to claim 1 including a discharge hood at the outlet end of the rotary dryer and wherein the exhaust means to exhaust the hot gases from the outlet end of the dryer includes an exhaust duct from the discharge hood leading to an exhaust fan and wherein a pressure sensor is provided in the discharge hood with a damper means in the exhaust duct to maintain a negative pressure within the dryer.

12. The carbon reactivation apparatus according to claim 10 including a temperature sensor positioned before the exhaust fan with a further damper means to provide an air supply to feed into the exhaust duct prior to the exhaust fan to ensure the exhaust gas entering the exhaust fan is maintained at a preset temperature.

13. The carbon reactivation apparatus according to claim 10 wherein a temperature sensor is positioned at a location where the exhaust duct leaves the outlet end of the dryer with a second damper means in a second exhaust line from the ducting leading up to the inlet end of the rotary dryer, the second exhaust line connecting to the exhaust duct leading to the exhaust fan, the second damper means controlling the temperature within the dryer in accordance with a preset temperature.

14. The carbon reactivation apparatus according to claim 1 including a temperature sensor positioned in the furnace shell connecting to a fuel supply valve to provide fuel to the heating means to control the temperature within the furnace shell.

15. The carbon reactivation apparatus according to claim 10 including a pressure sensor at the discharge end of the kiln with a third damper means on a third exhaust line from the discharge end of the kiln to the exhaust duct leading to the exhaust fan, the third damper means controlling the pressure within the kiln.

* * * * *